US006981300B2

(12) United States Patent
Tsai et al.

(10) Patent No.: US 6,981,300 B2
(45) Date of Patent: Jan. 3, 2006

(54) PIEZOELECTRIC INK JET PRINT HEAD AND FABRICATION METHOD FOR A PRESSURE CHAMBER THEREOF

(75) Inventors: Chih-Chang Tsai, Kaohsiung (TW); Ming-Hsun Yang, Hsinchu (TW)

(73) Assignee: Nanodynamics Inc., Hsinchu (TW)

( * ) Notice: Subject to any disclaimer, the term of this patent is extended or adjusted under 35 U.S.C. 154(b) by 211 days.

(21) Appl. No.: 10/653,621

(22) Filed: Sep. 2, 2003

(65) Prior Publication Data

US 2004/0051760 A1 Mar. 18, 2004

(30) Foreign Application Priority Data

Sep. 12, 2002 (TW) ..... 91120855 A

(51) Int. Cl.
*H04R 17/00* (2006.01)

(52) U.S. Cl. ..... 29/25.35; 29/890.1; 216/27; 347/68

(58) Field of Classification Search ..... 29/25.35, 29/890.1, 830; 347/54, 68–72, 40; 310/328; 216/27, 42, 48, 99
See application file for complete search history.

(56) References Cited

U.S. PATENT DOCUMENTS 5,581,861 A * 12/1996 Lee et al. ..... 29/25.35
6,096,656 A * 8/2000 Matzke et al. ..... 438/702
6,334,670 B1 * 1/2002 Yoshihira et al. ..... 347/65
6,701,593 B2 * 3/2004 Lin et al. ..... 29/25.35

* cited by examiner

*Primary Examiner*—David P. Bryant
*Assistant Examiner*—Sarang Afzali
(74) *Attorney, Agent, or Firm*—Thomas, Kayden, Horstemeyer & Risley

(57) ABSTRACT

A piezoelectric ink jet print head and a fabrication method for a pressure chamber thereof. A silicon substrate has at least one large-size opening. A photoresist layer is formed in the large-size opening of the silicon substrate and has a plurality of small-size trenches spaced apart from each other. Each of the small-size trenches serves as a pressure chamber. An adhesion layer is formed overlying the silicon substrate to cover the photoresist layer and the small-size trenches. A silicon layer is formed overlying the adhesion layer to serve as a vibrating layer.

2 Claims, 10 Drawing Sheets

PIEZOELECTRIC INK JET PRINT HEAD AND FABRICATION METHOD FOR A PRESSURE CHAMBER THEREOF

BACKGROUND OF THE INVENTION

1. Field of the Invention

The invention relates to a pressure chamber of a piezoelectric ink jet print head and a fabrication method thereof, and more particularly to a fabrication method of forming a plurality of small-size trenches in a photoresist layer which fills a large-size opening of a silicon wafer.

2. Description of the Related Art

A piezoelectric ink jet print head employs a forced voltage to deform a piezoelectric ceramic body, and uses flexure displacement of the piezoelectric ceramic body to change the volume of a pressure chamber, thus the chamber expels an ink droplet. Since high-temperature gasification is omitted and the piezoelectric ceramic body has a quick response without restriction against thermal conductivity, the piezoelectric ink jet print head has the advantages of superior durability, high-speed print performance, and superior print quality. The piezoelectric ink jet print head has been commercialized into a bend mode and a push mode according to its deformation mechanism. The bend mode uses a face-shooter piezoelectric deformation. When a voltage is exerted, a piezoelectric ceramic body is deformed and impeded by a vibrating plate, thus being laterally and extruding the ink in a pressure chamber. As a voltage difference arises between the internal space and the external circumstance, the ink adjacent to a nozzle orifice is accelerated and expelled as an ink droplet. Comparably, the push mode uses an edge-shooter piezoelectric deformation. When an opposite potential of the applied voltage between the two electrodes is continuously increased, a ceramic sidewall of an ink chamber bends outward to introduce ink. When the applied voltage is rapidly changed, a piezoelectric ceramic plate is deformed to cause a greater bending motion, thus the ink in the pressure chamber is extruded by a right-hand thrust and expelled from a nozzle orifice to form an ink droplet.

Conventionally, the vibrating plate and the pressure chamber are formed by a laminated ceramic co-fired method which includes steps of synthesizing raw powers (such as PZT, $ZrO_2$, Pbo, $TiO_2$ and other additives), mixing, drying, calcining, smashing, granulation, squeezing, shaping, sintering and polarization. The complicated and difficult procedure in the laminated ceramic co-fired method, however, has disadvantages of low yield and high cost and is unfavorable to mass production. Accordingly, a modified etching process for forming the pressure chamber and increasing process reliability thereof is called for.

Currently, in semiconductor etching processing, many approaches to a deep-hole etching technique have been developed and successfully applied to micro electromechanical structures. The deep-hole etching technique, such as a wet etching method through a chemical reaction or a dry etching process through a physical reaction, however, has the drawbacks of directional etching result, low etching rate and excessive process costs. Conventionally, a direct Si-wafer etching process cannot control the profile, depth, and uniformity of the pressure chambers, which causes the piezoelectric ink jet print head to fail in a high resolution performance.

SUMMARY OF THE INVENTION

Accordingly, an object of the present invention is to provide a fabrication method with wafer bonding, grinding, oxidation, photoresist filling, photolithography and etching for a pressure chamber of a piezoelectric ink jet print head to solve the problems caused by the conventional method.

According to the object of the invention, a fabrication method for a piezoelectric ink jet print head comprises the following steps. A silicon substrate is provided with at least one large-size opening. Then, the large-size opening of the silicon substrate is filled with a photoresist layer. Next, photolithography or etching is performed on the photoresist layer to form a plurality of small-size trenches spaced apart from each other, thus the small-size trench serves as a pressure chamber.

Another object of the present invention is to provide a fabrication method with wafer bonding, grinding, oxidation, photoresist filling, photolithography, and etching for a pressure chamber and a vibrating layer of a piezoelectric ink jet print head to solve the problems caused by the conventional method.

According to the object of the invention, a fabrication method for a piezoelectric ink jet print head includes the following steps. A first silicon wafer is provided with at least one large-size opening. Then, a second silicon wafer is provided. Next, an oxidation process is performed to form a first oxide layer overlying the first silicon wafer and a second oxide layer overlying the second silicon wafer. Next, a wafer bonding process is performed to bond the second silicon wafer to the first silicon wafer, in which the second oxide layer adheres to the first oxide layer to become an adhesion layer. Next, a grinding process is performed on the outer surface of the second silicon wafer, in which the remaining portion of the second silicon wafer serves as a silicon layer. Next, a piezoelectric material layer is formed overlying the silicon layer. Next, the large-size opening of the silicon substrate is filled with a photoresist layer. Finally, photolithography or etching is performed on the photoresist layer and the adhesion layer is used as a barrier layer, resulting in a plurality of small-size trenches spaced apart from each other.

DESCRIPTION OF THE DRAWINGS

The present invention will become more fully understood from the detailed description given hereinbelow and the accompanying drawings, given by way of illustration only and thus not intended to be limitative of the present invention.

DETAILED DESCRIPTION OF THE INVENTION

The present invention provides a piezoelectric ink jet print head and a fabrication method for a pressure chamber thereof. First, a large-size opening is formed within a predetermined region of a silicon wafer through an enforceable etching method, and then filled with a photoresist layer. Next, a plurality of small-size trenches spaced apart from each other is formed in the photoresist layer through a photolithography process or an enforceable etching method, thus each of the small-size trenches serves as a pressure chamber. Also, the fabrication method for the pressure chamber can integrate another silicon wafer with adhesion, bonding, grinding and etching processes to complete a vibrating layer. The vibrating layer and the pressure chamber are applied to a bend-mode piezoelectric ink jet print head or a push-mode piezoelectric ink jet print head.

First Embodiment

Figure 1A:
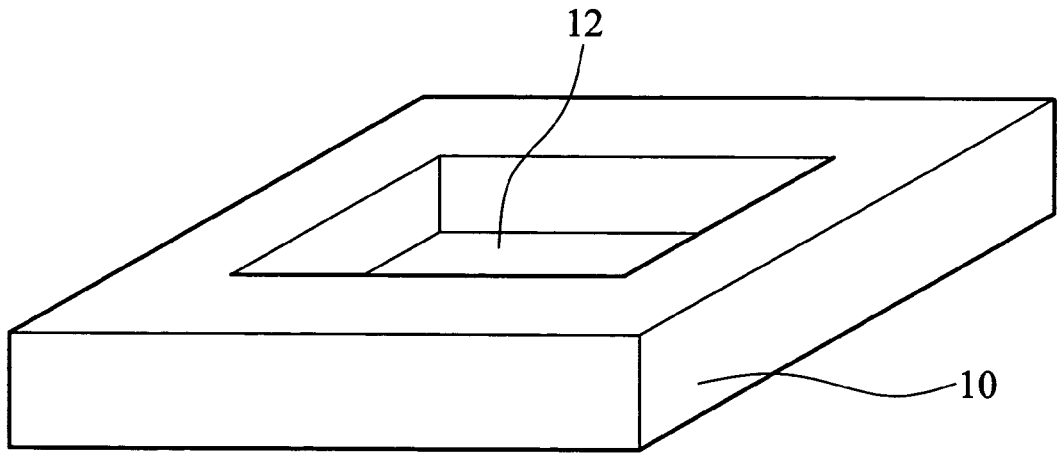
FIGS. 1A to 1C are three-dimensional views illustrating a fabrication method for a pressure chamber of a piezoelectric ink jet print head according to the first embodiment of the present invention.
Figure 1B:
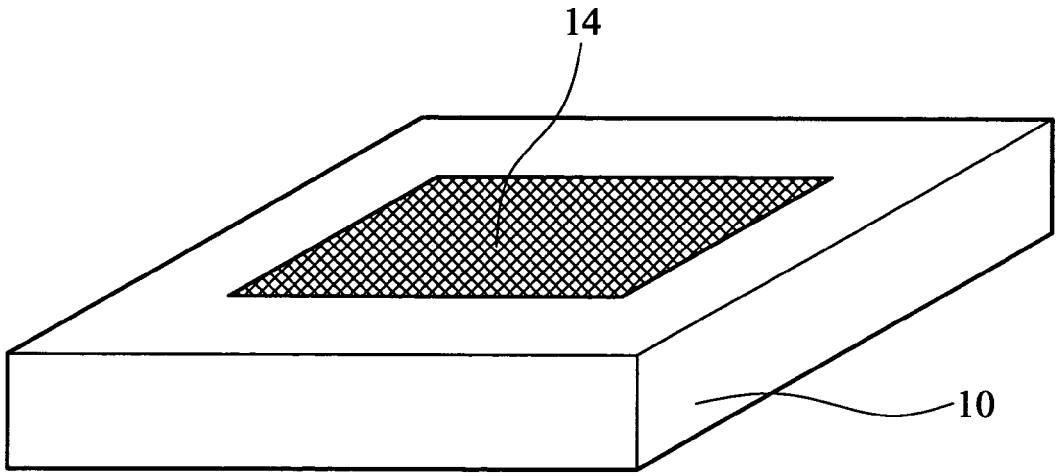
Figure 1C:
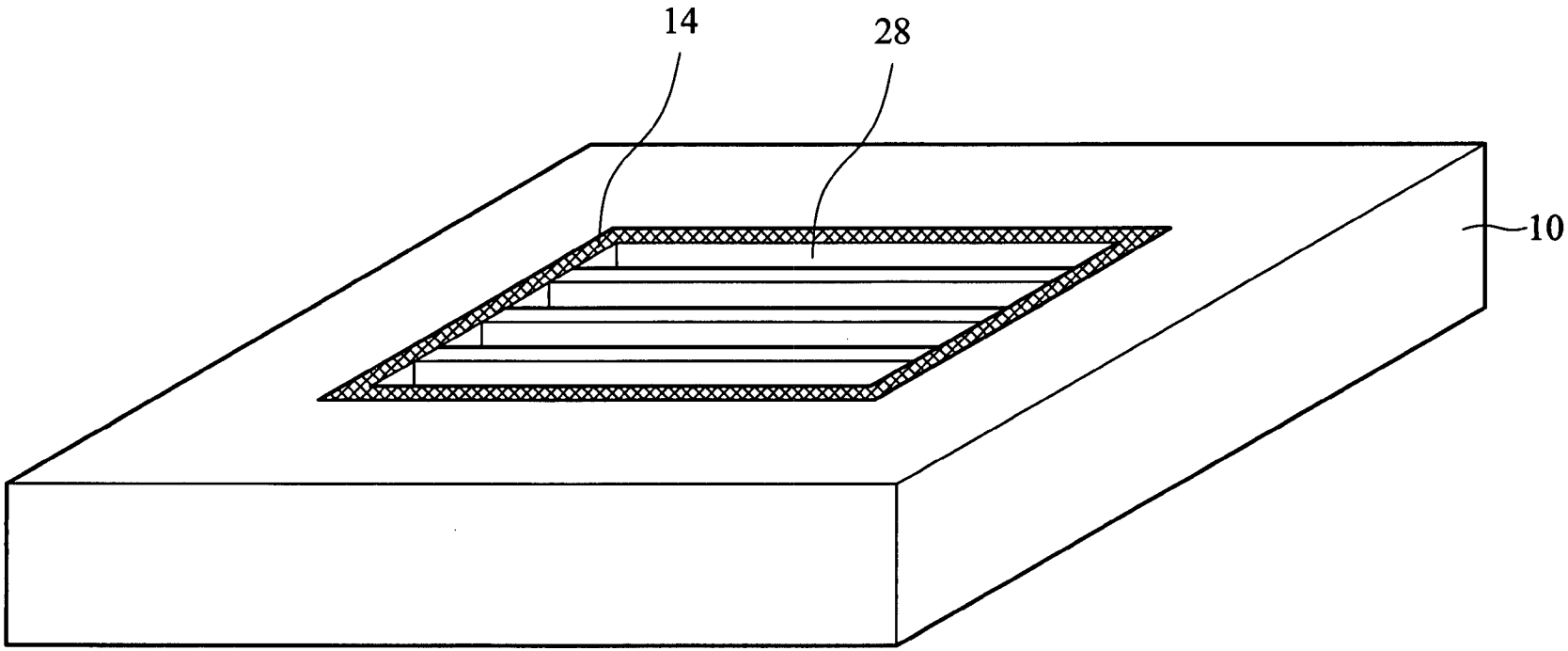

FIGS. 1A to 1C are three-dimensional views illustrating a fabrication method for a pressure chamber of a piezoelectric ink jet print head according to the first embodiment of the present invention. In FIG. 1A, a first silicon wafer 10, viewed as a frame, is provided with a large-size opening 12 within a predetermined region. The formation of the large-size opening 12 is selected from sand blasting, wet etching, dry etching or other enforceable etching methods. Also, depending on product specifications and process conditions, the quantity, size and profile of the large-size opening 12 can be appropriately modified. Preferably, the large-size opening 12 has a square measurement of 10000 $\mu$m×10000 $\mu$m. Then, in FIG. 1B, the large-size opening 12 is filled with a photoresist layer 14 through a photoresist coating method. Finally, in FIG. 1C, using a photolithography process or an enforceable etching method, a plurality of small-size trenches 28 spaced apart from each other is formed in the photoresist layer 14. Thus, each of the small-size trenches 28 serves as a pressure chamber of a piezoelectric ink jet print head. Also, depending on product specifications and process conditions, the quantity, size and profile of the small-size trenches 28 can be appropriately modified. Preferably, the small-size trench 28 has a rectangular measurement of 200 $\mu$m×3000 $\mu$m.

Second Embodiment

The second embodiment integrates the above-described fabrication method for the pressure chamber with wafer bonding, grinding, and etching to complete a vibrating layer.

FIGS. 2A to 2H illustrate a fabrication method for a pressure chamber and a vibrating layer of a piezoelectric ink jet print head according to the second embodiment of the present invention.

Figure 2A:
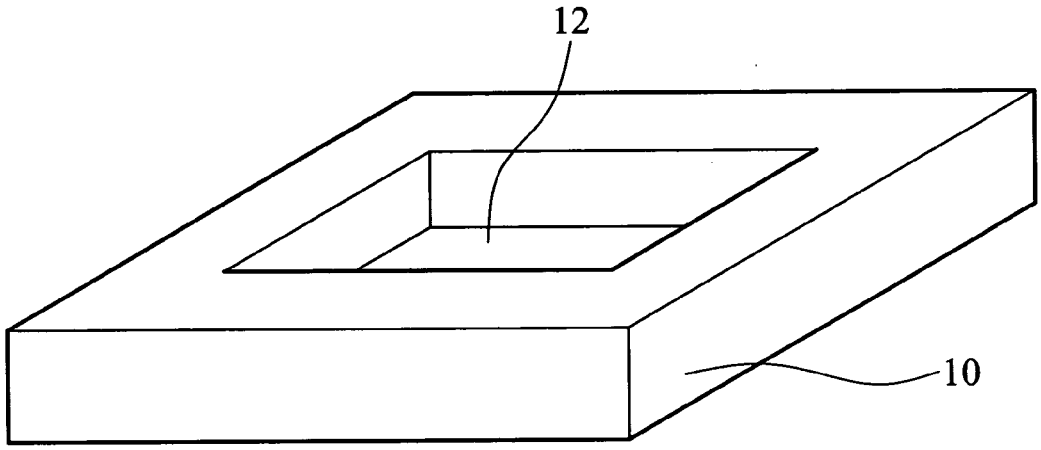
FIGS. 2A to 2H illustrate a fabrication method for a pressure chamber and a vibrating layer of a piezoelectric ink jet print head according to the second embodiment of the present invention.
Figure 2B:
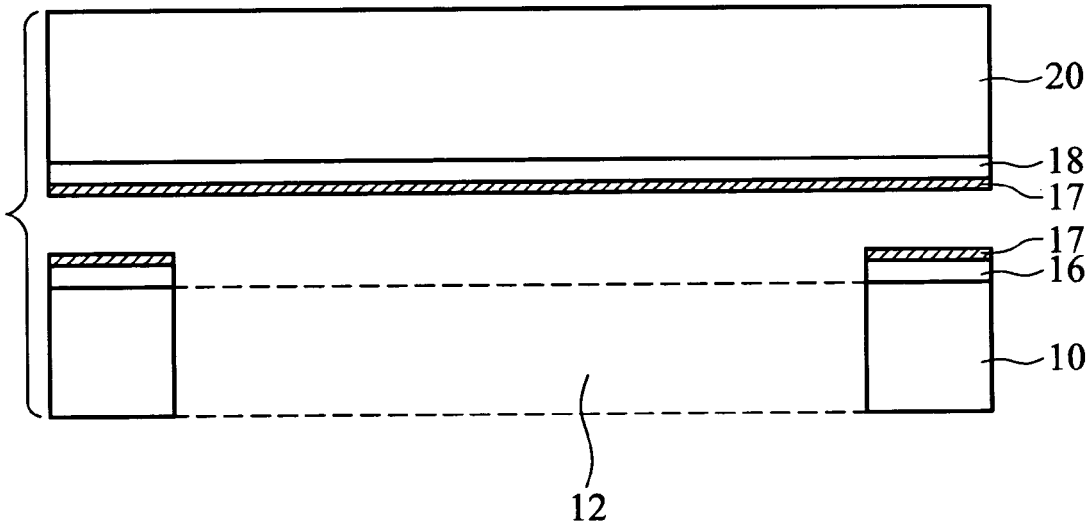
Figure 2C:
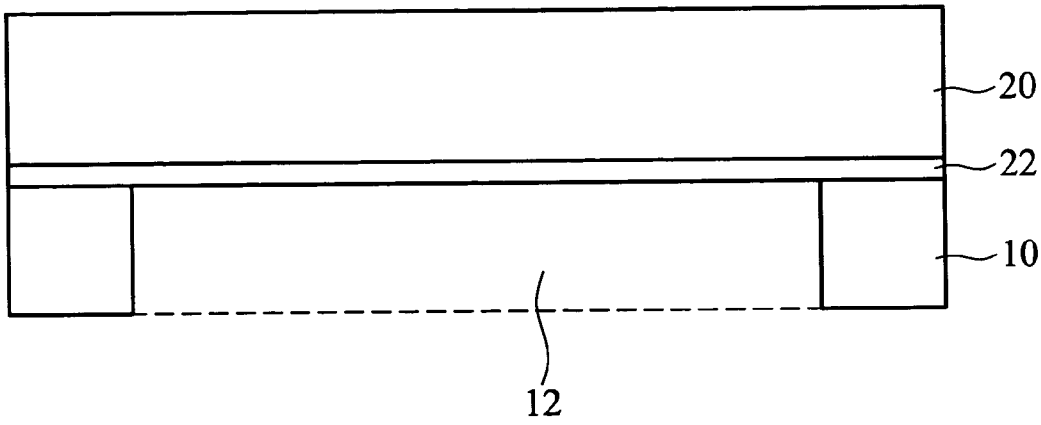
Figure 2D:
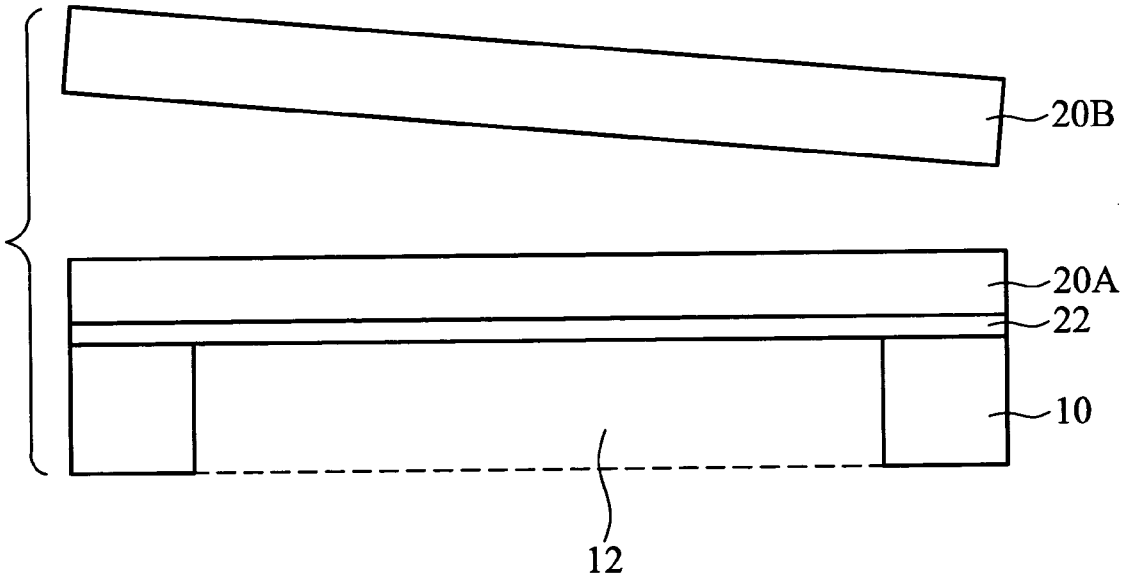

In a three-dimensional view of FIG. 2A, a first silicon wafer 10 is provided with a large-size opening 12 within a predetermined region. The formation of the large-size opening 12 in the second embodiment is substantially similar to that of the first embodiment, with the similar portion omitted herein.

Then, an SOI (silicon-on-insulator) technique is employed to bond the first silicon wafer 10 to another silicon wafer, resulting in a SOI substrate. In a cross-section of FIG. 2B, a thermal oxidation process is used to grow a first silicon oxide layer 16 on the first silicon wafer 10, and then a solution film 17 containing hydrogen bond (such as acetone or alcohol) is coated on the first silicon oxide layer 16. In the meantime, a second silicon wafer 20 is provided with a second silicon oxide layer 18 grown thereon through a thermal oxidation process, and then a solution film 17 containing hydrogen bond (such as acetone or alcohol) is coated on the second silicon oxide layer 18. Next, in the cross-section of FIG. 2C, a wafer bonding process is used to temporarily bond the second silicon oxide layer 18 downward to the first silicon oxide layer 16 through the solution film 17, resulting in a silicon oxide adhesion layer 22. Then, a wafer alignment method and a wafer press method are used to tightly bond the second silicon wafer 20 downward to the first second silicon wafer 10. Next, in a cross-section of FIG. 2D, a grinding process, such as a chemical mechanical polishing (CMP) method, is used to polish the second silicon wafer 20, thus the top portion 20B is removed until the remaining portion 20A reaches a thickness of 5~20 $\mu$m. Thus, the remaining silicon layer 20A of the second silicon wafer 20 serves as a vibrating layer 20A. A grinding process, such as a chemical mechanical polishing (CMP) method, may be optionally used to polish the bottom of the first silicon wafer 10 until its thickness reaches a predetermined depth for a subsequent pressure chamber process.

Figure 2E:
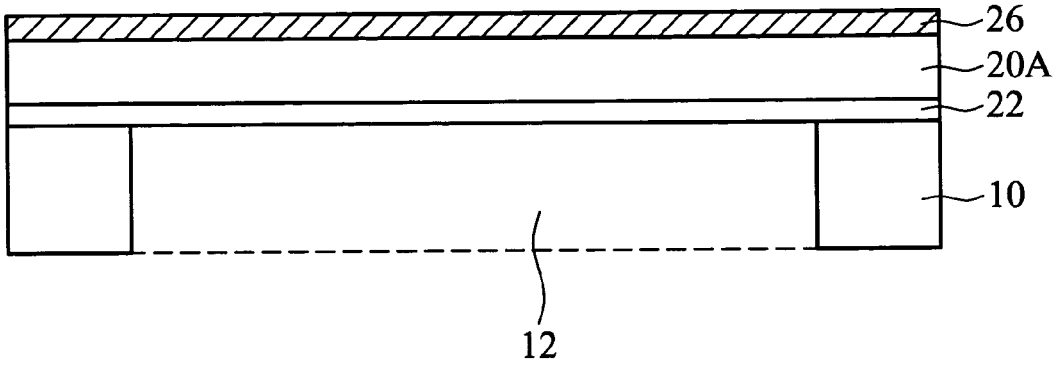
Figure 2F:
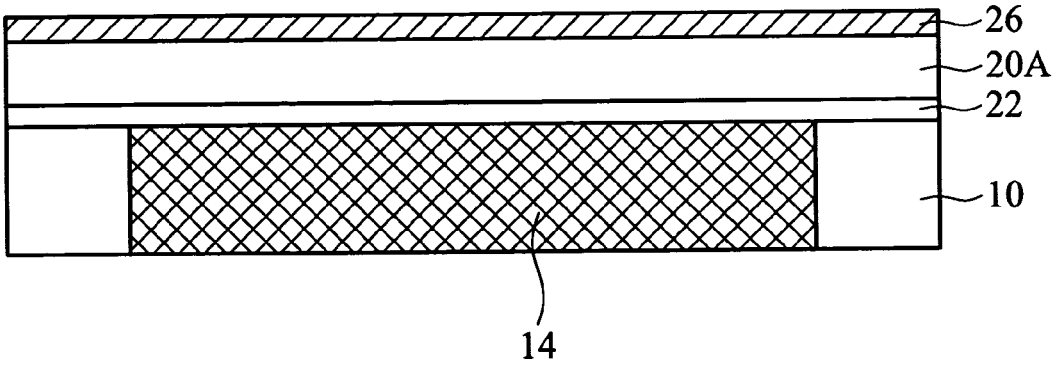
Figure 2G:
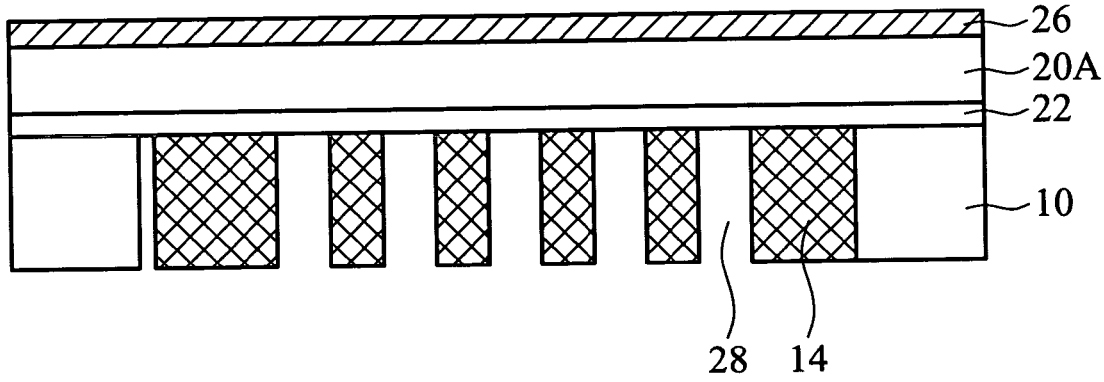
Figure 2H:
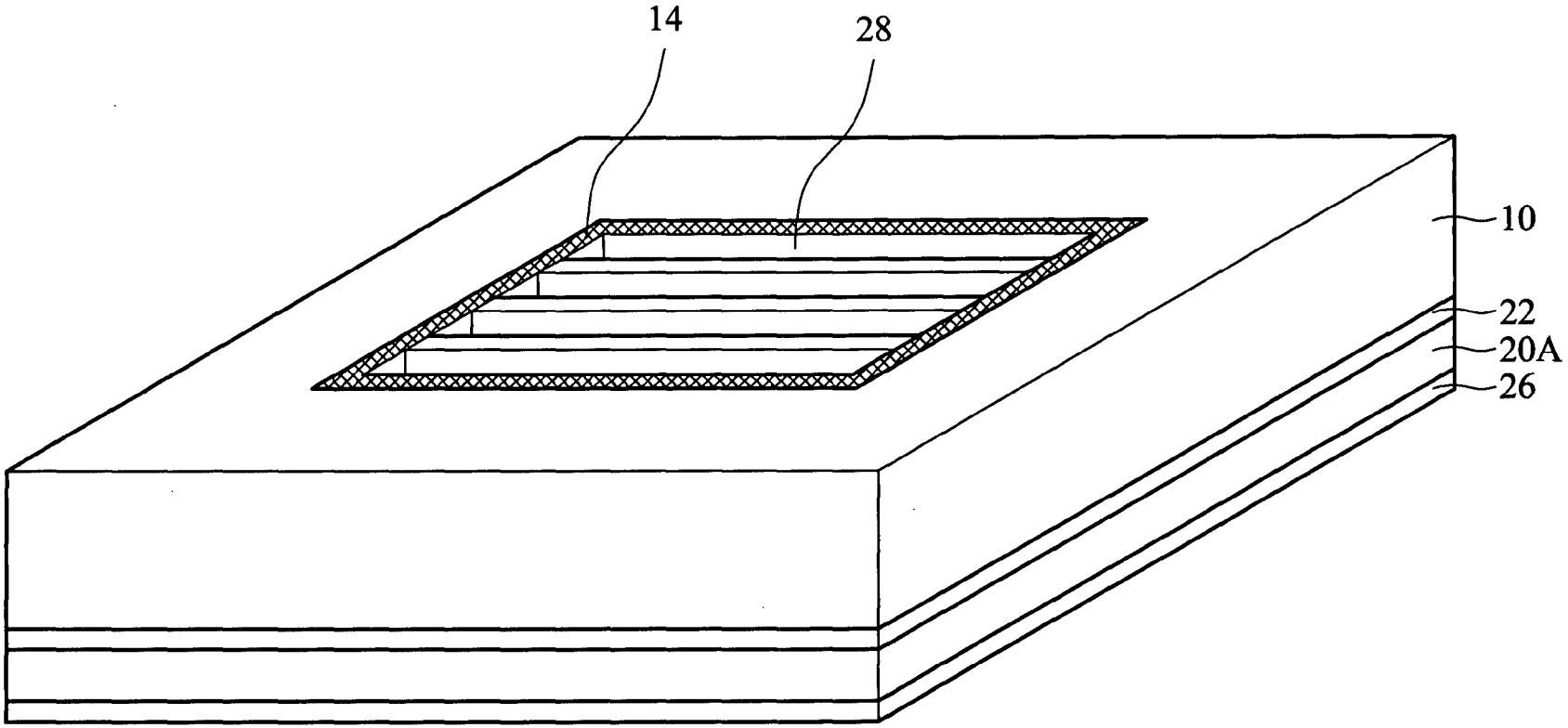

Next, in a cross-section of FIG. 2E, a piezoelectric material layer 26 is formed on the silicon layer 20A. Then, in a cross-section of FIG. 2F, the large-size opening 12 of the first silicon wafer 10 is filled with a photoresist layer 14. Finally, in a cross-section shown in FIG. 2G and a three-dimensional view of FIG. 2H, the silicon oxide adhesion layer 22 is used as a barrier layer, and a photolithography process or an enforceable etching method is performed on the photoresist layer 14 to form a plurality of small-size trenches 28 spaced apart from each other. Thus, each of the small-size trenches 28 serves as a pressure chamber.

Subsequent processes for an ink slot, nozzle orifices and a nozzle plate will be performed under the pressure chamber, which are omitted herein.

The formation of the pressure chamber employs the ordinary photolithography process including steps of soft baking, exposure, developing and hard baking to form the small-size trenches 28 in the photoresist layer 14 without performing a direct wet etching or a direct dry etching on the first silicon wafer 10. Thus, the problems of bevel defects, low etching rate, and excessive process cost encountered in the conventional silicon etching process are avoided. Also, the present invention integrates wafer bonding, grinding and etching to form the silicon layer 20A as the vibrating layer from the top of the second silicon wafer 20, and form the small-size trench 28 of the photoresist layer 14 as the pressure chamber from the bottom of the first silicon wafer 10. Thus, the present invention can simplify the procedure, reduce process difficulties, and increase process reliability, resulting in high yield, low cost and great production.

Third Embodiment

The fabrication method for a pressure chamber and a vibrating layer of a piezoelectric ink jet print head in the third embodiment is substantially similar to that of the second embodiment, with the similar portions omitted herein. The different portion is the wafer bonding method, in which an adhesion agent is used to replace the SOI technique so as to further simplify process steps and reduce process costs.

FIGS. 3A to 3F are cross-sections illustrating a fabrication method for a pressure chamber and a vibrating layer of a piezoelectric ink jet print head according to the third embodiment of the present invention.

Figure 3A:
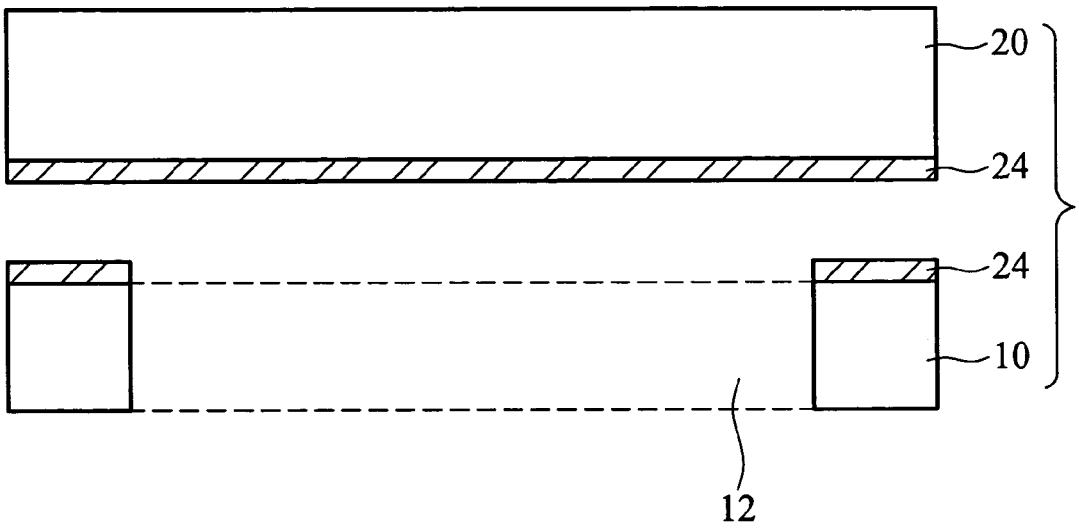
FIGS. 3A to 3F are cross-sections illustrate a fabrication method for a pressure chamber and a vibrating layer of a piezoelectric ink jet print head according to the third embodiment of the present invention.

In FIG. 3A, a first silicon wafer 10 is provided with a large-size opening 12 within a predetermined region, and then an adhesion layer 24 is coated on the first silicon wafer

10. A second silicon wafer 20 is provided with an adhesion layer 24. Preferably, the adhesion layer 24 is selected from resin, phosphosilicate glass (PSG), spin-on glass (SOG) or a dry film.

Figure 3B:
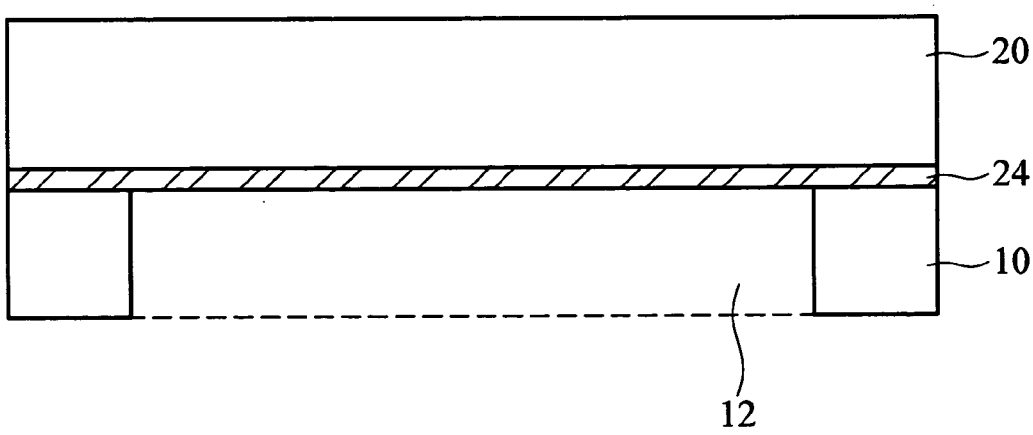

Next, in FIG. 3B, the second silicon wafer 20 is placed downward to temporarily adhere to the first silicon wafer 10 through the adhesion layer 24. Then, a wafer alignment method and a wafer press method are used to tightly bond the second silicon wafer 20 downward to the first second silicon wafer 10.

Figure 3C:
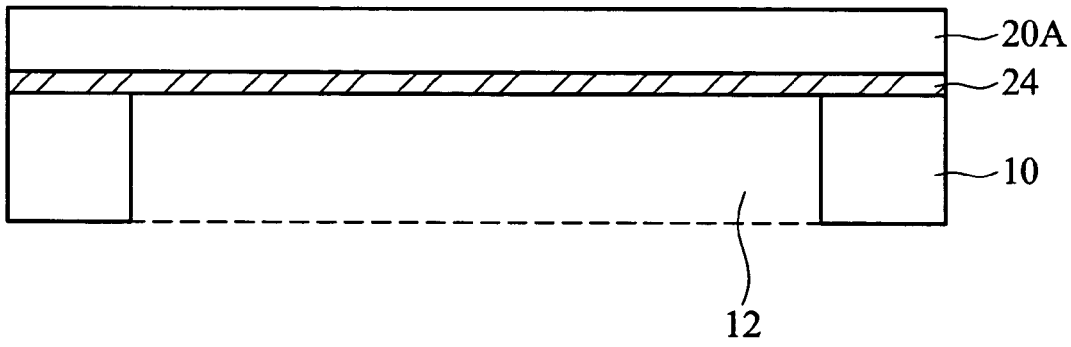

Next, in FIG. 3C, a grinding process, such as a chemical mechanical polishing (CMP) method, is used to polish the second silicon wafer 20 until the remaining portion 20A reaches a thickness of 5~20 $\mu$m. Thus, the remaining silicon layer 20A serves as a vibrating layer 20A. A grinding process, such as a chemical mechanical polishing (CMP) method, is optionally used to polish the bottom of the first silicon wafer 10 until its thickness reaches a predetermined depth for a subsequent pressure chamber process.

Figure 3D:
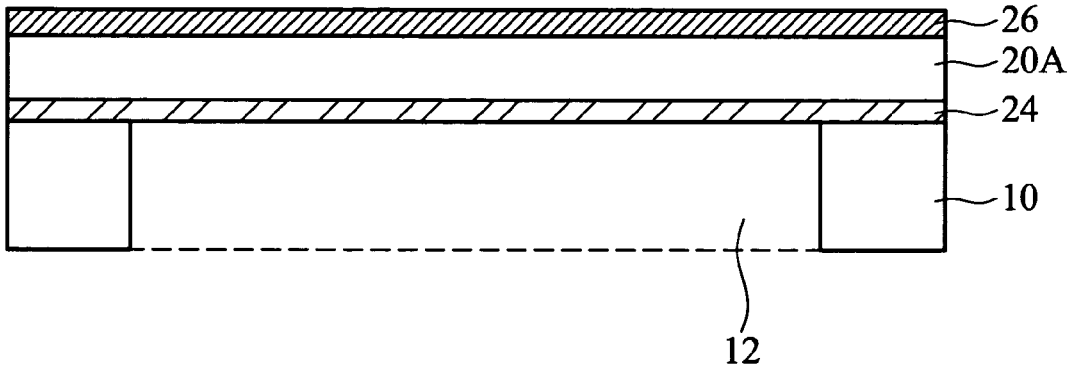
Figure 3E:
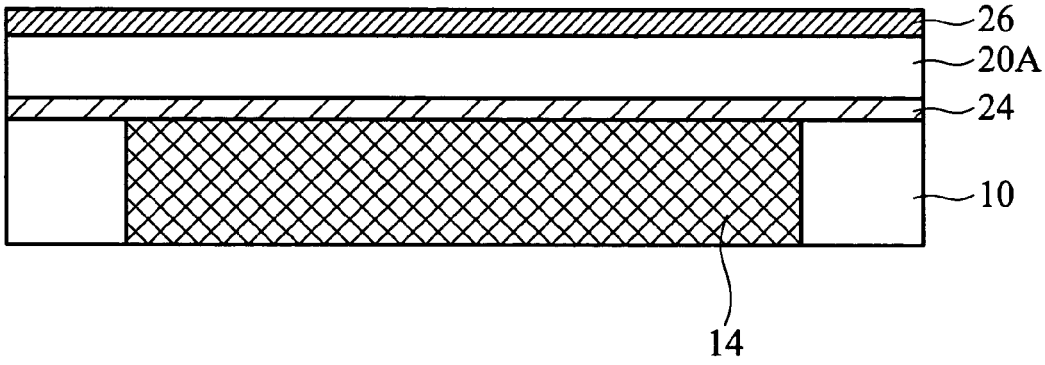
Figure 3F:
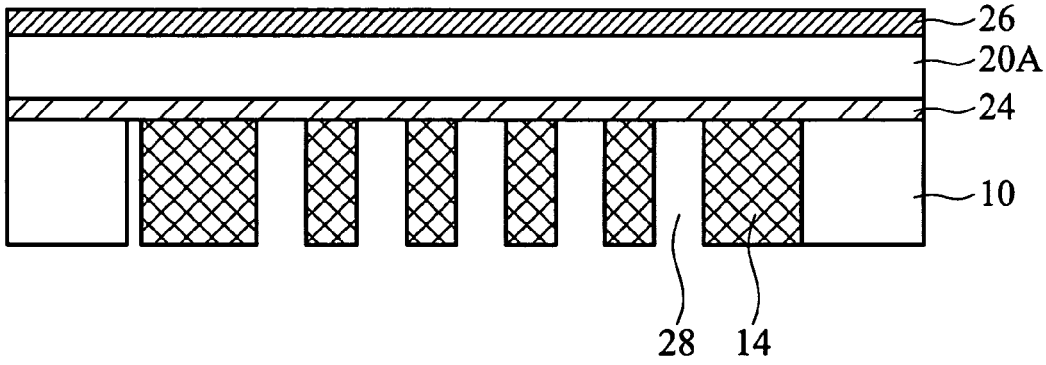

Next, in FIG. 3D, a piezoelectric material layer 26 is formed on the silicon layer 20A. Then, in FIG. 3E, the large-size opening 12 of the first silicon wafer 10 is filled with a photoresist layer 14. Finally, in FIG. 3F, the adhesion layer 24 is used as a barrier layer, and a photolithography process or an enforceable etching method is performed on the photoresist layer 14 to form a plurality of small-size trenches 28 spaced apart from each other. Thus, each of the small-size trenches 28 serves as a pressure chamber.

Subsequent processes for an ink slot, nozzle orifices and a nozzle plate will be performed under the pressure chamber, which are omitted herein.

While the invention has been described by way of example and in terms of the preferred embodiments, it is to be understood that the invention is not limited to the disclosed embodiments. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A fabrication method for a piezoelectric ink jet head, comprising steps of:

providing a silicon substrate comprising at least one large-size opening;

filling the at least one large-size opening of the silicon substrate with a photoresist layer; and performing photolithography or etching on the photoresist layer to form a plurality of isolated small-size trenches spaced apart from each other, in which each isolated small-size trench serves as a pressure chamber.

2. The fabrication method for a piezoelectric ink jet print head as claimed in claim 1, wherein the at least one large-size opening is formed by wet etching or dry etching.

* * * * *